US007798874B2

(12) United States Patent
Fukuoka

(10) Patent No.: US 7,798,874 B2
(45) Date of Patent: Sep. 21, 2010

(54) OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 31 days.

(21) Appl. No.: 12/340,819

(22) Filed: Dec. 22, 2008

(65) Prior Publication Data

US 2009/0170385 A1 Jul. 2, 2009

(30) Foreign Application Priority Data

Dec. 28, 2007 (JP) ..... 2007-340005

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS 4,802,871 A * 2/1989 Watanabe et al. ..... 440/75
5,180,319 A 1/1993 Shiomi et al.
5,421,755 A * 6/1995 Kakizaki ..... 440/63
5,881,991 A 3/1999 Bonin
2008/0070739 A1 3/2008 Nakamura et al.
2008/0233815 A1 9/2008 Nakamura et al.
2009/0047847 A1 * 2/2009 Gruenwald ..... 440/75

FOREIGN PATENT DOCUMENTS

WO 2007/007707 A1 1/2007

OTHER PUBLICATIONS

Fukuoka; "Outboard Motor"; U.S. Appl. No. 12/340,822, filed Dec. 22, 2008.

* cited by examiner

*Primary Examiner*—Stephen Avila
(74) *Attorney, Agent, or Firm*—Keating & Bennett, LLP

(57) ABSTRACT

An outboard motor includes a lower casing provided below an upper casing, amounting plate provided above the upper casing, and an engine with a vertically-arranged crankshaft mounted on the mounting plate. The rotation of the crankshaft is transmitted to a drive shaft that is pivotally supported in the upper casing, changed in speed by a transmission mounted on the drive shaft, and transmitted to a propeller shaft that is pivotally supported in the lower casing. The outboard motor has upper mounts and lower mounts arranged to mount the outboard motor on a hull. The upper mounts are disposed on upper lateral surfaces of the upper casing, and the lower mounts are disposed on lower lateral surfaces of the upper casing. The outboard motor simplifies the upper casing for disposing a transmission therein and assembly and maintenance thereof.

5 Claims, 4 Drawing Sheets

OUTBOARD MOTOR

BACKGROUND OF THE INVENTION

1. Field of the Invention

The present invention relates to an outboard motor having a mechanism for transmitting engine power to a propeller through a shaft, and especially relates to an outboard motor equipped with a transmission for changing the rotational speed of a shaft.

2. Description of the Related Art

Conventionally, in an outboard motor, engine power is transmitted to a crankshaft, a drive shaft, and a propeller shaft, and then is transmitted to a propeller from the propeller shaft. Conventionally, the engine power is transmitted as is to the propeller through each of the aforementioned shafts. Thus, when it is desired to change the speed of a watercraft, the engine power is adjusted to change the rotational speed of each shaft, so that the rotational speed of the propeller is changed subsequently to cause a change in the speed of the watercraft.

However, recent outboard motors have been provided with a transmission on a drive shaft, and are adapted to change the speed of a watercraft with the transmission rather than relying exclusively on the engine power (see WO 2007/007707, for example).

It is often the case that a conventional outboard motor has a plurality of mounts for supporting and mounting the outboard motor to a hull, and usually has two upper mounts and two lower mounts. Of these mounts, the two upper mounts are often disposed on a mounting plate provided above an upper casing that supports a drive shaft therein while having a short distance therebetween.

However, when the two upper mounts of the outboard motor are disposed on the mounting plate provided above the upper casing while having the short distance therebetween, the mounting plate as well as an upper section of the upper casing that is joined to the mounting plate become narrow in width. However, a transmission that is mounted on the drive shaft and disposed in the upper casing has a considerable width. Thus, if the upper section of the upper casing is narrowed, the transmission cannot be inserted from above the upper casing during installation of the transmission in the upper casing. Consequently, problems arise such as a complicated structure of the upper casing and a troublesome assembly work. The transmission has to be inserted from another insertion opening such as one separately provided for the transmission in order to dispose the transmission in the upper casing. In addition, it may happen that the transmission has to be mounted on the drive shaft after being inserted in the upper casing.

In addition, in the outboard motor in which the upper mounts and the lower mounts are disposed on different members such that the upper mounts are disposed on the mounting plate and the lower mounts are disposed on the upper casing, first, the outboard motor has to be detached from the hull along with the mounting plate and the upper casing in order to remove the transmission from the outboard motor during maintenance of the transmission. Then, after the outboard motor is detached from the hull, the transmission is removed for the maintenance. This causes a problem of complicating the maintenance work.

Furthermore, conventionally, in an outboard motor, the engine, the mounting plate, and the upper casing are jointly secured by a through bolt from the upper casing side. Still further, the mounting plate and the upper casing are secured by another bolt. As described above, among the conventional outboard motors, there are motors that are supported and mounted to the hull by the upper mounts disposed on the mounting plate and by the lower mounts disposed on a lower section of the upper casing.

In the outboard motors having such a construction, when only the engine is disassembled for maintenance, the engine can be removed by unscrewing the through bolts while the outboard motor remains supported and mounted to the hull by each of the mounts. However, when the through bolts are used, the positions of the through bolts are determined according to the exterior shape of the engine. Therefore, it is difficult to enlarge only the upper casing, for example.

SUMMARY OF THE INVENTION

In view of the foregoing circumstances, preferred embodiments of the present invention provide an outboard motor that can simplify the constitution of an upper casing in which a transmission is disposed and that can simplify assembly and maintenance processes.

According to a preferred embodiment of the present invention, an outboard motor includes a lower casing located below an upper casing, a mounting plate located above the upper casing, and an engine with a vertically-arranged crankshaft mounted on the mounting plate. The rotation of the crankshaft is transmitted to a drive shaft pivotally supported in the upper casing, has its rotational speed changed via a transmission mounted on the drive shaft, and the rotational force thereof is transmitted to a propeller shaft pivotally supported in the lower casing. The outboard motor has an upper mount and a lower mount arranged to mount the outboard motor to a hull. The upper mount is disposed on an upper lateral surface of the upper casing, and the lower mount is disposed on a lower lateral surface of the upper casing.

In addition, a top surface opening through which the transmission can be inserted from above and which is covered by the mounting plate is preferably provided in a top surface of the upper casing.

Furthermore, the mounting plate preferably is disposed on the upper casing such that the transmission is attached to a bottom surface of the mounting plate and such that the engine is attached to a top surface of the mounting plate.

Moreover, the upper casing preferably includes a divider that is arranged to divide the inside of the upper casing into a front chamber and a rear chamber, and the transmission is disposed in the front chamber.

Still further, the engine is preferably bolted on the mounting plate, the crankshaft is disposed on the inside of a bolted position, and the mounting plate and the upper casing are bolted on the outside of the bolted position.

According to a preferred embodiment of the present invention, the outboard motor has the upper mount and the lower mount arranged to mount the outboard motor to the hull, and the upper mount is disposed on the upper lateral surface of the upper casing. Thus, an upper section of the upper casing can be widened, and the transmission can be inserted from above the upper casing during assembly. In addition, since the lower mount is disposed on the lower lateral surface of the upper casing, both the upper mount and the lower mount are disposed on the upper casing. Accordingly, during maintenance, it is possible to take out the mounting plate, the engine, and the transmission while the upper casing remains supported by and mounted to the hull. Consequently, the upper casing that includes the transmission disposed therein can have a simple constitution. It is also possible to simplify the assembly and maintenance processes.

The top surface of the upper casing preferably includes the top surface opening through which the transmission can be inserted from above and which is covered by the mounting plate. Therefore, the transmission can be inserted and disposed in the upper casing from the top surface opening while being mounted on the mounting plate. Consequently, the insertion and the disposition of the transmission in the upper casing can further be simplified.

The mounting plate is preferably disposed on the upper casing such that the engine is attached to the top surface of the mounting plate and such that the transmission is attached to the bottom surface of the mounting plate. Thus, the simultaneous disposition of the engine and the transmission can further simplify the assembly work.

The upper casing preferably includes the divider arranged to divide the inside of the upper casing into the front chamber and the rear chamber, and the transmission is disposed in the front chamber. Thus, the transmission can easily be located in a desired position in the upper casing, and can be prevented from being influenced by components disposed in the rear chamber (heat, oil content, and moisture, for example).

The engine is preferably bolted on the mounting plate, and the crankshaft is preferably disposed on the inside of the bolted position. The mounting plate and the upper casing are bolted on the outside of the bolted position. Thus, the securing of a sufficient fastening force is facilitated. In addition, since the number of members to be fastened is reduced, it is possible to prevent weakening of the fastening force due to changes over time. Furthermore, this unique arrangement provides much greater design freedom for the upper casing.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Description will hereinafter be made of preferred embodiments of the present invention.

Figure 1:
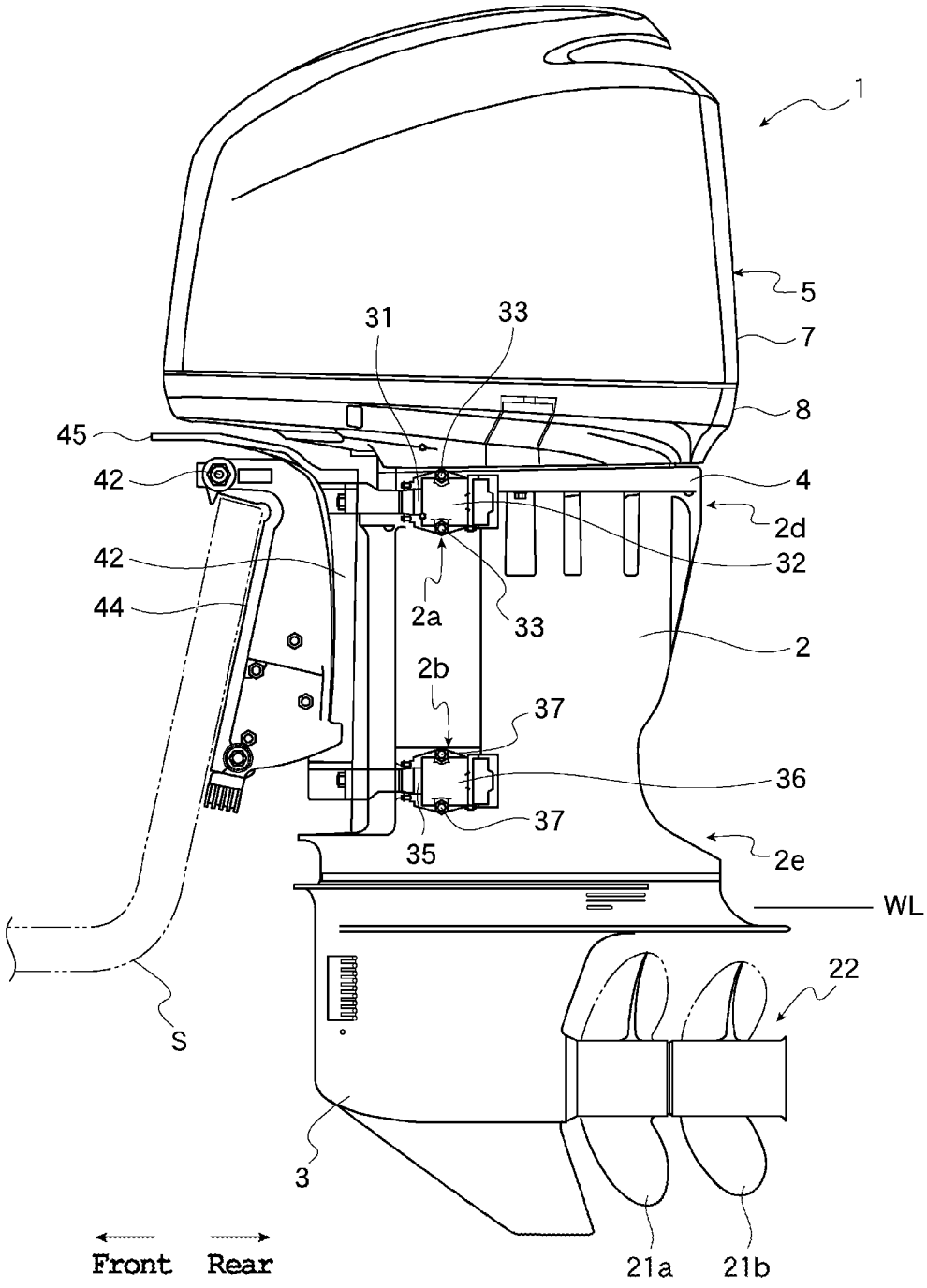
FIG. 1 is a left side view showing an outboard motor according to a preferred embodiment of the present invention.
Figure 2:
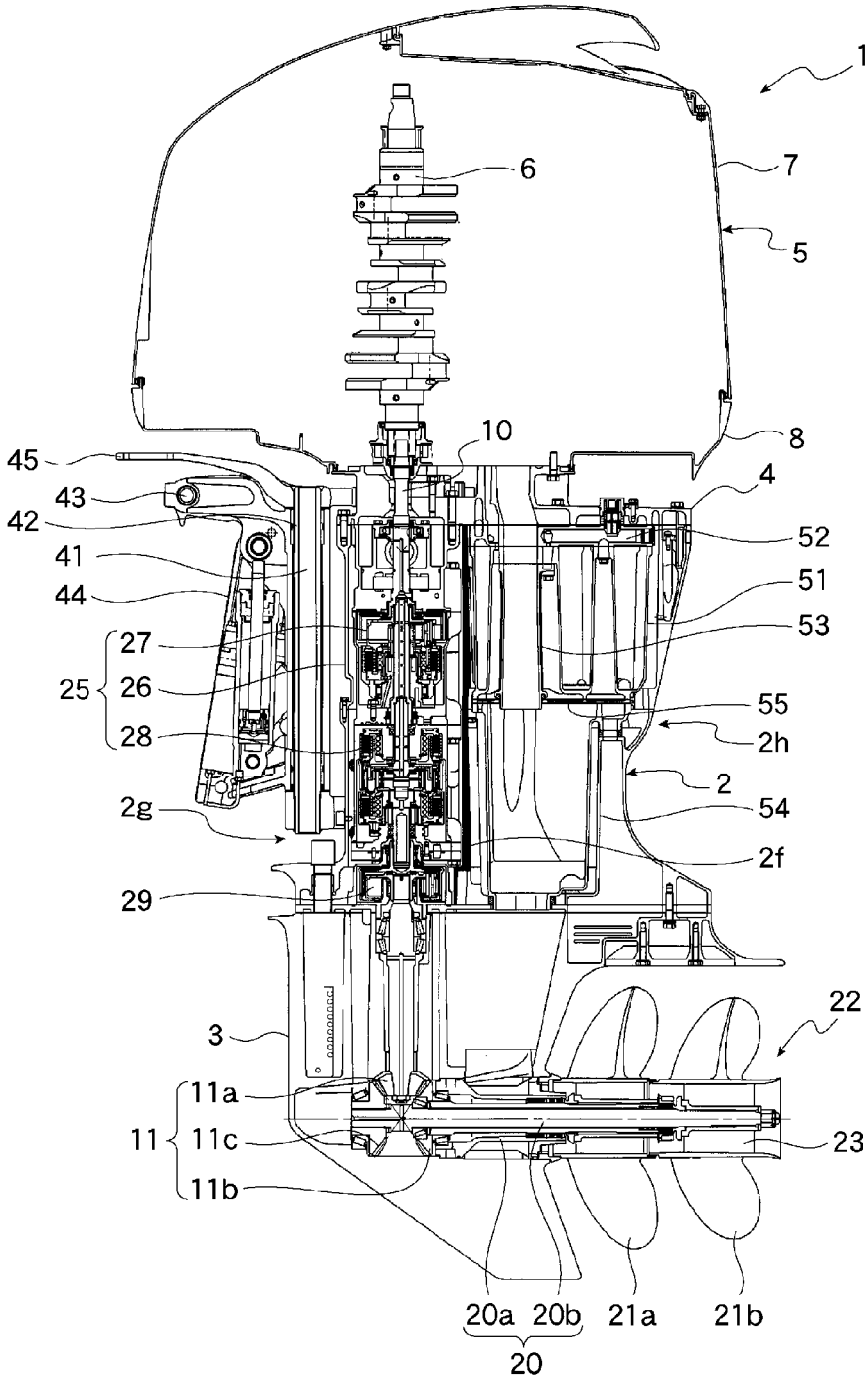
FIG. 2 is a longitudinal sectional view showing the outboard motor of FIG. 1 according to a preferred embodiment of the present invention where the outboard motor is cut by a vertical plane that is parallel or substantially parallel with a traveling direction of a watercraft.
Figure 3:
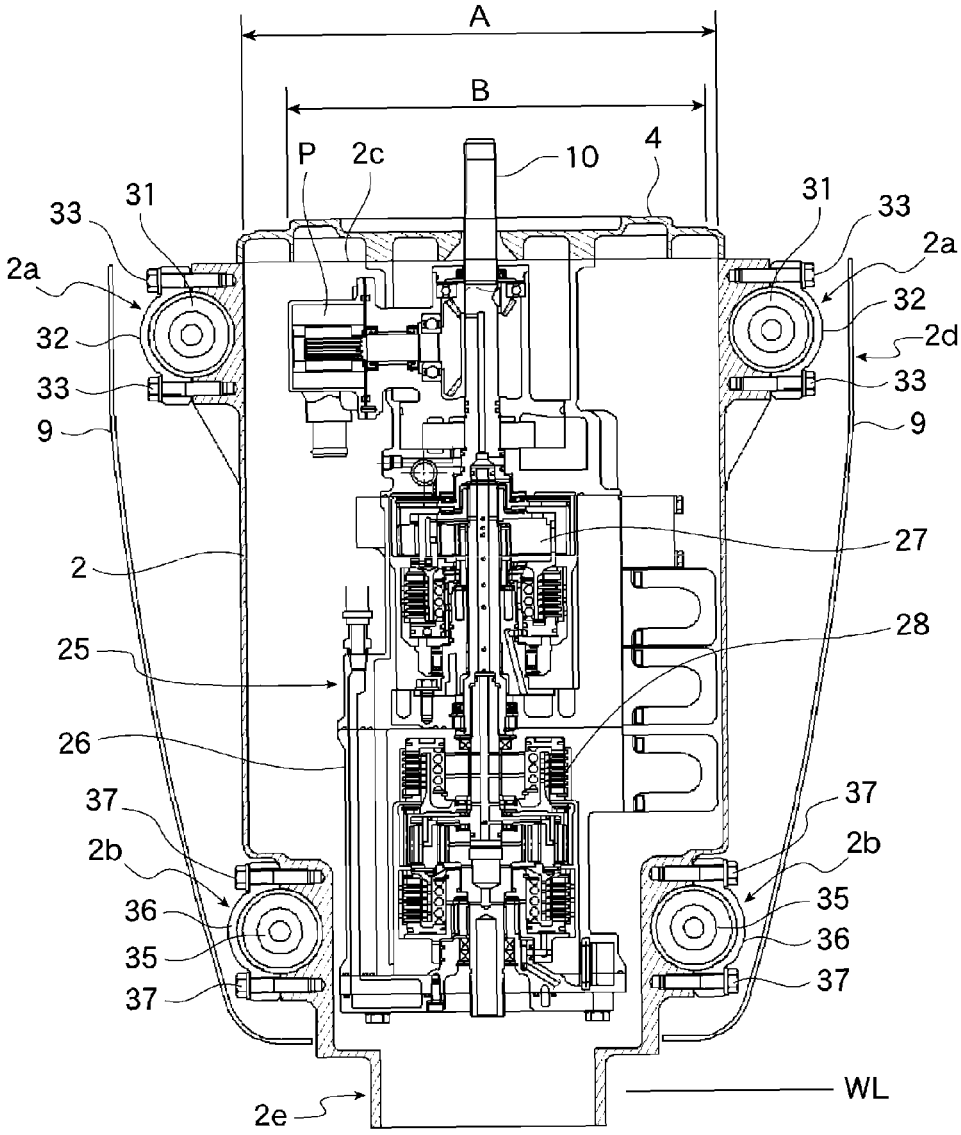
FIG. 3 is a longitudinal sectional view showing the outboard motor of FIG. 1 according to a preferred embodiment of the present invention where a front chamber of an upper casing of the outboard motor is cut by the vertical plane that is perpendicular or substantially perpendicular to the traveling direction of the watercraft.
Figure 4:
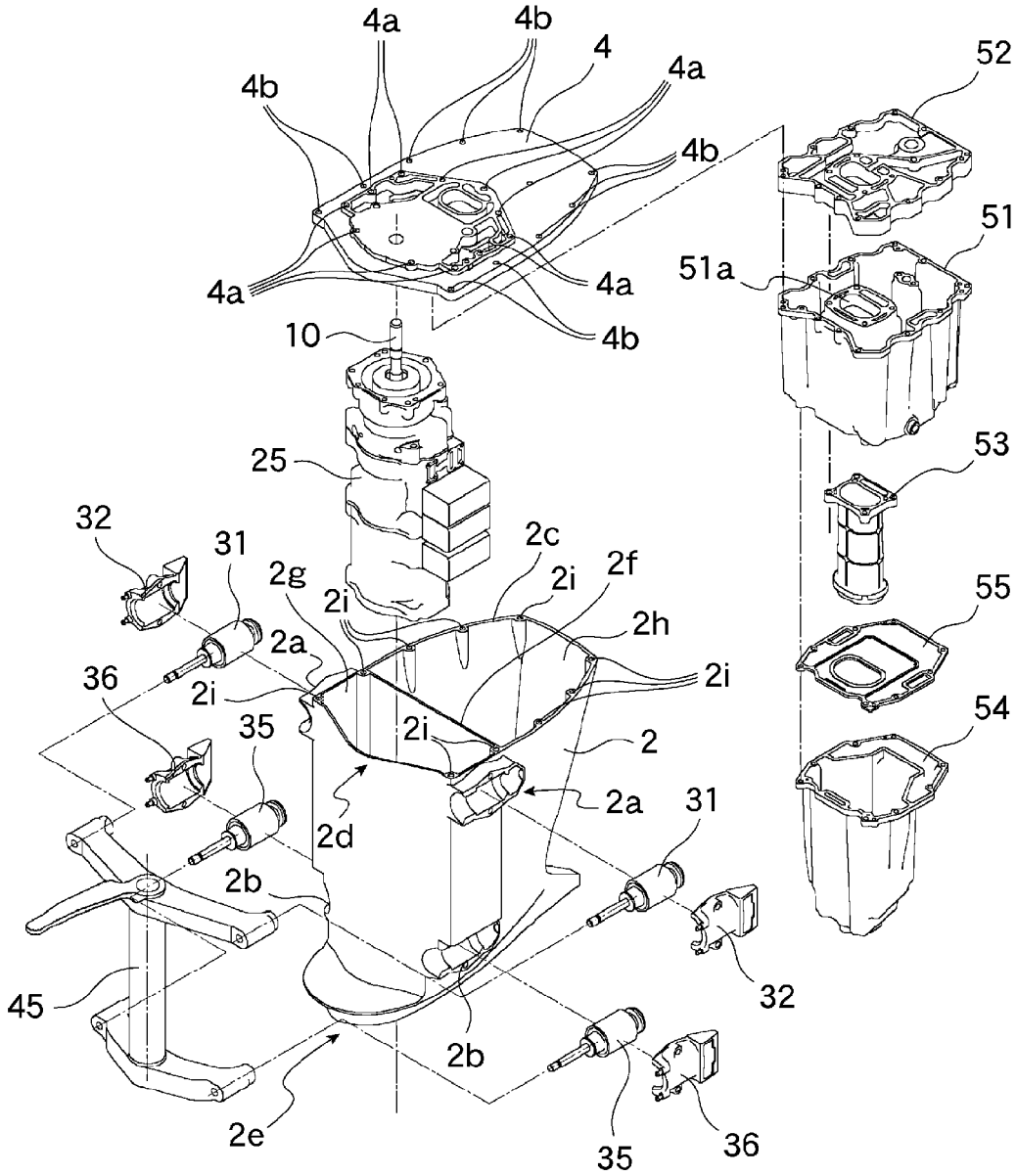
FIG. 4 is an exploded perspective view of the upper casing and surrounding members of the outboard motor of FIG. 1 according to a preferred embodiment of the present invention.

FIG. 1 is a left side view showing an outboard motor according to a preferred embodiment of the present invention. FIG. 2 is a longitudinal sectional view showing the outboard motor of FIG. 1 according to a preferred embodiment of the present invention where the outboard motor is cut by a vertical plane that is parallel or substantially parallel with a traveling direction of a watercraft. FIG. 3 is a longitudinal sectional view showing the outboard motor of FIG. 1 according to a preferred embodiment of the present invention where a front chamber of an upper casing is cut by a vertical plane that is perpendicular or substantially perpendicular to the traveling direction of the watercraft. FIG. 4 is an exploded perspective view of the upper casing and surrounding members of the outboard motor of FIG. 1 according to a preferred embodiment of the present invention.

As shown in FIGS. 1 and 2, in an outboard motor 1 of the present preferred embodiment, a lower casing 3 is provided below an upper casing 2, and an engine 5 is mounted above the upper casing 2 via a generally flat mounting plate 4. The engine 5 preferably is, for example, a water-cooled V6 engine and is mounted on the mounting plate 4 such that a crankshaft 6 thereof is arranged to extend in a vertical position.

The engine 5 is covered by a detachable upper cover 7 and a detachable lower cover 8. As shown in FIG. 3, a right side surface and a left side surface of the upper casing 2 are covered by a side cover 9, which is also detachable. In addition, as shown in FIG. 4, the engine 5 is preferably fixed to the mounting plate 4 preferably by a plurality of fixing bolts (not shown) that are inserted and fastened in a plurality of engine-side bolt holes (not shown) formed in the engine 5 and in a plurality of engine fastening bolt holes 4*a* (bolted positions) formed in the mounting plate 4. Then, the crankshaft 6 is disposed on the inside of the plurality of engine fastening bolt holes (bolted positions) 4*a*, that is, on the inside of an area surrounded by the plurality of engine fastening bolt holes 4*a*.

As shown in FIGS. 3 and 4, the upper casing 2 preferably has a box-shaped body preferably made of metal such as aluminum alloy, and the mounting plate 4 is disposed on a top surface thereof. The mounting plate 4 and the upper casing 2 are securely fastened such that a plurality of fixing bolts (not shown) is inserted in a plurality of upper-case fastening bolt holes 4*b* arranged on the edge, which is located outside the plurality of engine fastening bolt holes (bolted positions) 4*a* formed in the mounting plate 4, and in a plurality of upper-casing side bolt holes 2*i* located on the edge of the top surface of the upper casing 2. Meanwhile, the lower casing 3 is fixed to a bottom surface of the upper casing 2 preferably by fixing bolts, which are not shown.

As shown in FIGS. 3 and 4, the width of a front chamber 2*g* in an upper section 2*d* of the upper casing 2 (a width A of an upper surface opening 2*c*, which will be described later) can be set to be relatively large or thick by disposing upper mounts 31, which will be described later, on upper lateral surfaces 2*a* on the right and the left of the upper casing 2. In this preferred embodiment, the front chamber 2*g* preferably has a relatively large width according to the size and shape of a transmission 25 so that the transmission 25, which will be described below, can be inserted therein from above. In addition, a lower section 2*e* of the upper casing 2 preferably has a relatively small width in accordance with a joined surface of the lower casing 3 to which the lower section 2*e* is joined.

As shown in FIGS. 2 and 4, the upper casing 2 preferably is divided by a divider 2*f* into a front chamber and a rear chamber (the front and rear in the traveling direction of the watercraft indicated by the arrow in FIG. 1). The front chamber 2*g* (forward chamber) is a space in which a drive shaft 10, the transmission 25, and the like are disposed. Meanwhile, a rear chamber 2*h* (rearward chamber) is a space to dispose therein an oil pan 51 for holding lubricating oil, an oil pan cover 52 to cover the oil pan 51, an exhaust pipe 53 that is arranged to communicate with an exhaust hole 51*a* formed in the oil pan 51 and that lets exhaust gases discharged from the engine pass through, an exhaust expansion chamber 54 arranged to expand the exhaust gases passed through the exhaust pipe 53, an exhaust chamber cover 55 disposed between the exhaust expansion chamber 54 and the exhaust pipe 53, a drain pipe (not shown) through which cooling water drawn by a water pump P, which will be described below, and supplied to the engine 5 is discharged, and the like. The engine is lubricated with the oil housed in the oil pan 51. In addition, the exhaust gases discharged from the engine flow to an exhaust passage 23, which will be described below, via the exhaust pipe 53 and the expansion chamber 54, is mixed with cooling water to be discharged, and is discharged together in the water.

In the front chamber 2*g* arranged to house therein the transmission 25 among other components, and in the rear chamber 2*g* arranged to house therein the exhaust pipe 53 through which hot exhaust gases pass, the exhaust expansion chamber 54, the oil pan 51 containing the lubricating oil, the drain pipe (not shown) arranged to drain cooling water, and the like, the divider 2*f* of the upper casing 2 preferably has a structure made with a material and thickness that prevents the front chamber 2*g* from receiving any influences or effects from the rear chamber 2*h* such as a possible danger due to oil or water leakage at a high temperature. In addition, since the divider 2*f* divides the upper casing 2 into the front portion and the rear portion, the divider 2*f* increases the rigidity of the upper casing 2 against forces that may cause twisting, bending, deformation and the like.

As shown in FIGS. 2 and 3, the vertical drive shaft 10 is pivotally supported in the front chamber 2*g* of the upper casing 2. The upper end of the drive shaft 10 is coupled to the lower end of the crankshaft 6 of the engine 5 preferably by spline-fitting, for example. The drive shaft 10 extends downward through the upper casing 2, reaches the inside of the lower casing 3, and links to a propeller shaft 20 pivotally supported in the lower casing 3 in a horizontal manner via a bevel gear mechanism 11.

As shown in FIGS. 2 to 4, the transmission 25 is provided in the front chamber 2*g* of the upper casing 2. The transmission 25 is mounted on the drive shaft 10 and is arranged to house a speed-changing planetary gear mechanism 27 and a forward/reverse switch 28 in a transmission case 26 that defines an outer shell of the transmission 25. In addition, a final deceleration device 29 that utilizes a planetary gear mechanism is provided right under the transmission 25.

As shown in FIG. 2, the propeller shaft 20 is preferably a double-rotary shaft that coaxially combines an outer shaft 20*a* with an inner shaft 20*b*. A drive bevel gear 11*a* of the bevel gear mechanism 11 rotates as a unit with the drive shaft 10, a driven bevel gear lib thereof rotates as a unit with the outer shaft 20*a*, and a driven bevel gear 11*c* thereof rotates as a unit with an inner shaft 20*b*. A first propeller 21*a* is fixed to the outer shaft 20*a*, and a second propeller 21*b* is fixed to the inner shaft 20*b*. These propellers make up a contra-rotating propeller mechanism 22. An exhaust passage 23 is provided in the axes of the first propeller 21*a* and the second propeller 21*b*.

As shown in FIG. 3, the water pump P provided to draw cooling water for the engine 5 is disposed in the upper casing 2, for example, in the right side thereof in the traveling direction of the watercraft. An installation position of the water pump P is higher than that of the transmission 25 and is also sufficiently higher than a waterline WL during operation of the outboard motor 1 (see FIGS. 1 and 3).

In the outboard motor 1 constituted as described above, when the engine 5 is started, the rotation of the crankshaft 6 is transmitted to the drive shaft 10, and the speed and forward/reverse direction of the rotation of the drive shaft 10 is changed in the transmission 25. Furthermore, the rotation of the drive shaft 10 is decelerated by the final deceleration device 29 and is transmitted to the propeller shaft 20. Then, a pair of the outer shaft 20*a* of the propeller shaft 20 and the first propeller 21*a* and a pair of the inner shaft 20*b* and the second propeller 21*b* rotate in opposite directions to produce a high propulsive force.

As shown in FIGS. 1, 3, and 4, the outboard motor 1 is supported by and mounted to a hull S via the upper mount 31 disposed in the upper casing 2 and a lower mount 35 also disposed in the upper casing 2.

More specifically, in this preferred embodiment, two upper mounts 31 are preferably included, and the two upper mounts 31 are disposed on the upper lateral surfaces 2*a* in the right and the left of the upper section 2*d* of the upper casing 2 as seen in FIG. 3. Then, the upper mounts 31 are held against the upper lateral surfaces 2*a* from the right and left outside with upper-mount holding members 32 and are fixed by upper-mount mounting bolts 33.

In addition, two lower mounts 35 are preferably included in this preferred embodiment, and the two lower mounts 35 are disposed on lower lateral surfaces 2*b* in the right and left of the lower section 2*e* of the upper casing 2 as seen in FIG. 3. Then, the lower mounts 35 are held against the lower lateral surfaces 2*b* from the right and left outside with lower-mount holding members 36 and are fixed by lower-mount mounting bolts 37.

A steering bracket 45 is fixedly coupled to a front section of the outboard motor 1 via the upper mounts 31 and the lower mounts 35. Then, the steering bracket 45 is coupled to a swivel bracket 42 by a vertical steering shaft 41 shown in FIG. 2. The swivel bracket 42 is coupled to a clamp bracket 44 via a horizontal tilt shaft 43 and a lock mechanism, which is not shown. The clamp bracket 44 is fixed to a transom of the hull S.

The outboard motor 1 can steer the hull S by pivoting to the right and the left about the steering shaft 41, and can also be tilted up above the water surface by pivoting vertically about the tilt shaft 43.

A pair of the right and left upper mounts 31 and a pair of the right and left lower mounts 35 in this preferred embodiment support the weight of the outboard motor 1, and increase a spring constant by increasing the hardness of elastic members such as rubber disposed in the upper mounts 31 and the lower mounts 35 in order to facilitate the transmission of the propulsive force generated by the outboard motor 1 to the hull S.

In the upper casing 2 of this preferred embodiment, the two upper mounts 31 are disposed on the upper lateral surfaces 2*a* of the upper casing 2. Thus, as shown in FIG. 3, a distance between the two upper mounts 31 is widened. Accordingly, the width A (a length perpendicular or substantially perpendicular to the traveling direction of the watercraft) of the top surface opening 2*c* that opens in the top surface of the upper casing 2 can be set wider (longer) than a width B (a length perpendicular or substantially perpendicular to the traveling direction of the watercraft) of the transmission 25. Thus, the transmission 25 can be inserted in the upper casing 2 from above during assembly of the outboard motor 1. Consequently, the installation work of the transmission 25 is facilitated.

In addition, the transmission 25 can be inserted and disposed in the upper casing 2 from above the upper casing 2 through the top surface opening 2*c*. Thus, there is no need to fabricate an insertion hole especially for the insertion and disposition of the transmission case 25 in the upper casing 2, and the upper casing 2 can have a simple structure. As a result, it is possible to reduce and minimize the cost for the outboard motor 1.

The transmission 25 is preferably attached in advance to the bottom surface of the mounting plate 4, and the transmission 25 and the mounting plate 4 in the above condition are inserted in the upper casing 2 from above through the top surface opening 2*c*. Accordingly, the number of assembly steps to be performed after the insertion of the transmission in the upper casing 2 can be reduced. Therefore, it is possible to further simplify the process related to the insertion and disposition of the transmission 25 during the assembly of the outboard motor 1.

Furthermore, while the transmission 25 is attached to the bottom surface of the mounting plate 4, the engine 5 is attached to the top surface of the mounting plate 4. Then, these components are integrally disposed in the upper casing 2. Consequently, the number of assembly steps to be performed after the insertion of the transmission 25 in the upper casing 2 can further be reduced. Therefore, it is possible to further simplify the process related to the insertion and disposition of the transmission 25 during the assembly of the outboard motor 1.

These simplified and easier assembly processes and the resultant advantages cannot be achieved with an upper casing having a short distance between upper mounts. These can only be achieved with the outboard motor 1 according to preferred embodiments of the present invention due at least in part to the unique structure in which the upper mounts 31 and the lower mounts 35 are respectively disposed on the upper lateral surfaces 2*a* and the lower lateral surfaces 2*b*.

Moreover, in the outboard motor 1 of this preferred embodiment, as described above, the two upper mounts 31 and the two lower mounts 35 are all disposed on the upper casing 2. Accordingly, when the engine 5 or the transmission 25 has to be removed from the outboard motor 1 for maintenance and the like, the engine 5, the mounting plate 4, the transmission 25, and the like can be removed from the outboard motor 1 while the upper case 2 remains supported by and mounted to the hull S. Consequently, the maintenance steps and processes can be simplified, and thus, the maintenance can be performed effectively and efficiently.

As described above, when the transmission 25 is inserted and disposed in the upper casing 2 while being attached to the bottom surface of the mounting plate 4, the transmission 25 can further easily be removed from the outboard motor 1. Therefore, the maintenance can be performed even more effectively and efficiently.

Still further, as described above, when the transmission 25 and the engine 5 are disposed in the upper case 2 in the state that the transmission 25 is attached to the bottom surface of the mounting plate 4 and that the engine 5 is attached to the top surface of the mounting plate 4, they can be removed all at once. Therefore, the maintenance can be performed further effectively.

As described so far, according to the outboard motor 1 of this preferred embodiment, the two upper mounts 31 and the two lower mounts 35 are included to mount the outboard motor 1 to the hull S, and the upper mounts 31 are disposed on the upper lateral surfaces 2*a* of the upper casing 2. Thus, it is possible to extend the width of the upper section 2*d* of the upper casing 2 and to insert the transmission 25 in the upper casing 2 from above during assembly. Furthermore, since the lower mounts 35 are disposed on the lower lateral surfaces 2*b* of the upper casing 2, the upper mounts 31 and the lower mounts 35 are both disposed on the upper casing 2. Accordingly, during the maintenance, it is possible to take out the mounting plate 4, the engine 5, and the transmission 25 while the upper casing 2 remains attached to the hull S. Consequently, the upper casing 2 for housing the transmission 25 therein can have a simple structure. It is also possible to simplify the assembly and maintenance processes.

According to the outboard motor 1 of the above-described preferred embodiment, the top surface of the upper casing 2 is preferably formed with the top surface opening 2*c* through which the transmission 25 can be inserted from above and which is covered with the mounting plate 4. Therefore, the transmission 25 can be inserted and disposed in the upper casing 2 from the top surface opening 2*c* while the transmission 25 is attached to the mounting plate 4. Consequently, it is possible to further simplify the insertion and disposition of the transmission 25 in the upper casing 2.

According to the outboard motor 1 of the above-described preferred embodiment, the mounting plate 4 is disposed on the upper casing 2 while the transmission 25 is attached to the bottom surface of the mounting plate 4, and the engine 5 is attached to the top surface of the mounting plate 4. Thus, the assembly process can further be simplified by simultaneously disposing the engine 5 and the transmission 25.

According to the outboard motor 1 of the above-described preferred embodiment, the divider 2*f* arranged to divide the inside of the upper casing 2 into the front chamber and the rear chamber is preferably provided, and the transmission 25 is disposed in the front chamber 2*g*. Therefore, the divider 2*f* can facilitate the disposition of the transmission 25 in a given position in the upper casing 2 and can prevent and minimize any influences of the components disposed in the rear chamber 2*h* (heat, oil content, and moisture, for example) to the transmission 25.

According to the outboard motor 1 of the above-described preferred embodiment, the engine 5 is preferably bolted on the mounting plate 4, and the crankshaft 6 is disposed on the inside of the bolted positions 4*a*. The mounting plate 4 and the upper casing 2 are preferably bolted on the outside of the bolted positions 4*a*. This facilitates the setting of the fastening force. In addition, since the number of members to be fastened is reduced, it is possible to prevent weakening of the fastening force due to changes over time. Furthermore, the unique structure and arrangement provide much greater freedom in design of the upper casing 2.

In other words, a mating surface between the engine 5 and the mounting plate 4 is defined with the cooling water passage (not shown) for cooling water to be supplied from the water pump P to the engine 5, an oil passage (not shown) for the lubricating oil supplied from the oil pan 51 to the engine 5, an exhaust passage (not shown) through which exhaust gases discharged from the engine 5 pass, and the like. Therefore, it is desirable to increase the fastening force between the two components and to minimize changes in the fastening force over time.

Given the above factors, by adopting the constitution such as one for the outboard motor 1 of the above-described preferred embodiment, the upper mounts 31 are disposed in the upper section of the upper casing 2, the lower mounts 35 are disposed in the lower section of the upper casing 2, the engine 5 is bolted on the mounting plate 4, and the mounting plate 4 is secured to the upper casing 2 by other bolts. Therefore, the engine 5 and the upper casing 2 are independently secured to the mounting plate 4.

Consequently, it is possible to facilitate the setting of the fastening force and also to prevent weakening of the fastening force due to change over time because of the reduced number of fastened members.

Due to this bolt fastening arrangement, when the engine 5 is removed, the mounting plate 4 and the engine 5 can be removed while the outboard motor 1 remains supported by mounts. Furthermore, the exterior shape of the upper casing 2 can be designed without consideration of that of the engine 5. Therefore, it can produce the effect of further freedom in design. Accordingly, it becomes possible to make the top surface opening 2*c* of the upper casing 2 so large that the transmission 25 and the like can be mounted in the upper casing 2 from above the upper casing 2.

The present invention is not limited to the preferred embodiments described above, and various modifications can be made without departing from the spirit and the technical scope thereof.

For example, the transmission 25 disposed in the upper casing 2 is not limited to one described in the above-described preferred embodiment, and a transmission having a broader width or a different shape may be provided, for example. In such a case, the upper casing 2 with the upper section 2*d* having a broader width, or the upper casing 2 with the upper section 2*d* that has a configuration that conforms to the transmission 25 may be provided.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

a lower casing arranged below an upper casing;

a mounting plate arranged above the upper casing; and an engine including a vertically-arranged crankshaft mounted on the mounting plate; wherein rotation of the crankshaft is transmitted to a drive shaft pivotally supported in the upper casing, has a speed thereof changed by a transmission mounted on the drive shaft, and is transmitted to a propeller shaft pivotally supported in the lower casing;

the outboard motor includes an upper mount and a lower mount arranged to mount the outboard motor to a hull;

the upper mount is disposed on an upper lateral surface of the upper casing;

the lower mount is disposed on a lower lateral surface of the upper casing;

a top surface of the upper casing includes a to surface opening through which the transmission can be inserted from above and which is covered by the mounting plate; and the mounting plate is disposed on the upper casing such that the transmission is attached to a bottom surface of the mounting plate and such that the engine is attached to a top surface of the mounting plate.

2. An outboard motor comprising:

a lower casing arranged below an upper casing;

a mounting plate arranged above the upper casing; and an engine including a vertically-arranged crankshaft mounted on the mounting plate; wherein rotation of the crankshaft is transmitted to a drive shaft pivotally supported in the upper casing, has a speed thereof changed by a transmission mounted on the drive shaft, and is transmitted to a propeller shaft pivotally supported in the lower casing;

the outboard motor includes an upper mount and a lower mount arranged to mount the outboard motor to a hull;

the upper mount is disposed on an upper lateral surface of the upper casing;

the lower mount is disposed on a lower lateral surface of the upper casing; and the upper casing is provided with a divider arranged to divide the inside of the upper casing into a front chamber and a rear chamber, and the transmission is disposed in the front chamber.

3. The outboard motor according to claim 2, wherein a top surface of the upper casing includes a top surface opening through which the transmission can be inserted from above and which is covered by the mounting plate.

4. An outboard motor comprising:

a lower casing arranged below an upper casing;

a mounting plate arranged above the upper casing; and an engine including a vertically-arranged crankshaft mounted on the mounting plate; wherein rotation of the crankshaft is transmitted to a drive shaft pivotally supported in the upper casing, has a speed thereof changed by a transmission mounted on the drive shaft, and is transmitted to a propeller shaft pivotally supported in the lower casing;

the outboard motor includes an upper mount and a lower mount arranged to mount the outboard motor to a hull;

the upper mount is disposed on an upper lateral surface of the upper casing;

the lower mount is disposed on a lower lateral surface of the upper casing; and the engine is bolted on the mounting plate, the crankshaft is disposed on the inside of a bolted position, and the mounting plate and the upper casing are bolted outside of the bolted position.

5. The outboard motor according to claim 4, wherein a top surface of the upper casing includes a top surface opening through which the transmission can be inserted from above and which is covered by the mounting plate.

* * * * *